US005905437A

United States Patent [19]

Takahashi

[11] Patent Number: 5,905,437

[45] Date of Patent: May 18, 1999

[54] PAGER WITH LOW VOLTAGE ALARM

[75] Inventor: Hiroyuki Takahashi, Yokohama, Japan

[73] Assignee: Matsushita Electric Industrial Co., Ltd., Japan

[21] Appl. No.: 08/762,786

[22] Filed: Dec. 10, 1996

[30] Foreign Application Priority Data

Dec. 18, 1995 [JP] Japan ..... 7-329039

[51] Int. Cl.[6] ..... G08B 21/00

[52] U.S. Cl. ..... 340/636; 340/663; 340/825.46

[58] Field of Search ..... 340/636, 663, 340/539, 311.1, 825.44, 825.46; 379/372, 374, 376, 34; 320/43; 324/430, 433

[56] References Cited

U.S. PATENT DOCUMENTS

| | | | |
|---|---|---|---|
| 4,872,005 | 10/1989 | DeLuca et al. | 340/825.46 |
| 4,918,438 | 4/1990 | Yamasaki | 340/825.46 |
| 5,032,835 | 7/1991 | DeLuca | 340/825.46 |
| 5,272,475 | 12/1993 | Eaton et al. | 340/825.46 |
| 5,304,986 | 4/1994 | Motegi | 340/636 |
| 5,327,120 | 7/1994 | McKee et al. | 340/825.46 |
| 5,365,226 | 11/1994 | Morishima | 340/825.44 |
| 5,442,345 | 8/1995 | Kwon | 340/636 |
| 5,638,421 | 6/1997 | Serrano et al. | 379/372 |
| 5,696,437 | 12/1997 | Panther et al. | 340/636 |

*Primary Examiner*—Jeffrey A. Hofsass
*Assistant Examiner*—Van T. Trieu
*Attorney, Agent, or Firm*—Rossi & Associates

[57] ABSTRACT

It is disclosed that a pager comprises: a receiving portion (1, 2) for receiving a radio wave paging signal and supplying a paging signal; an outputting portion (3, 6, 5) for outputting information when the paging signal is directed thereto; a power supplying portion (8, 9) for supplying a supply power; a detection portion (4) for detecting a voltage condition of the supply power; an operation portion (7) for generating a command signal in response to an operation; and an alarming portion (5, 6) for alarming when the operation portion generates the command signal after the detection of the low voltage condition. The pager may further comprise a timer (31) responsive to the detection portion. The alarming portion alarms in response to the timer if the operation portion does not generate the command signal within the predetermined time interval. The alarming portion generates an alarm sound or displays character data when the alarming portion alarms. There are two alarm sound tones, wherein one for the arrival of the paging signal and the other for informing the low voltage condition. The alarming portion may further alarm when detection of the low voltage condition.

8 Claims, 1 Drawing Sheet

11
1 ANTENNA
2a
RADIO WAVE PORTION
2
3
MPU
3a
CPU
3b
ROM
3c
RAM
31
TIMER
32
TIMER CONT PROGRAM
33
LOW VOLTAGE OF CONT PROGRAM
34
PAGING CONT PROGRAM
5
SOUND GEN PORTION
6
DISPLAY
10
S1
S2
7
OP PORTION
4
V DET CKT
R1
R2
V1
V2
8
V UP CONV
9 BATTERY

PAGER WITH LOW VOLTAGE ALARM

BACKGROUND OF THE INVENTION

1. Field of the Invention

This invention relates to a pager with a low voltage alarm.

2. Description of the Prior Art

It is known that a pager comprises an alarm portion for alarming to inform its user of a low voltage of a battery when a low voltage detection circuit detects that a voltage of a battery is lower than a reference.

SUMMARY OF THE INVENTION

The aim of the present invention is to provide an improved pager with low voltage alarm.

According to the present invention, it is provided that a pager comprises: a receiving portion for receiving a radio wave paging signal and supplying a paging signal; an outputting portion for at least outputting information indicative of an arrival of the paging signal when the paging signal is directed to this pager; a power supplying portion for supplying a supply power; a detection portion for detecting that a voltage of the supply power is lower than a reference; an operation portion for generating a command signal in response to an operation; and an alarming portion for alarming when the operation portion generates the command signal after the detection portion detects that the voltage of the supply power is lower than the reference.

The pager may further comprise: a timer portion for measuring a predetermined time interval in response to the detection portion, wherein the alarming portion alarms in response to the timer portion if the operation portion does not generate the command signal within the predetermined time interval. In this case, the alarming portion may further alarm when the detection portion detects that the voltage of the supply power is lower than the reference.

In the pager, the alarming portion may comprise a sound generation portion for generating an alarm sound when the alarming portion alarms. In this case, the sound generation portion generates the alarm sound having a first tone when the paging signal directed to this pager arrives and the alarm sound having a second tone informing the user when the detection portion detects that a voltage of the supply power is lower than a reference.

In the pager, the alarming portion may comprise a character display portion for displaying predetermined character data when the alarming portion alarms.

In the pager, the power supplying portion may comprise a battery for generating a first supply power and a voltage converter for generating a second supply power from the first supply power, the detection portion detects that the voltage of the supply power is lower than a reference by comparing a voltage of the first supply power with a first reference and comparing a voltage of the second supply power with a second reference, and the alarming portion alarms when the operation portion generates the command signal after the detection portion detects that the first voltage of the first supply power is lower than the first reference and when the operation portion generates the command signal after the detection portion detects that the second voltage of the second supply power is lower than the second reference.

In the pager, the radio wave paging signal includes paging information and the outputting portion further outputting the paging information from the receiving portion when the paging signal is directed to this pager.

BRIEF DESCRIPTION OF THE DRAWINGS

The object and features of the present invention will become more readily apparent from the following detailed description taken in conjunction with the accompanying drawing in which.

DETAILED DESCRIPTION OF THE INVENTION

Figure 1:
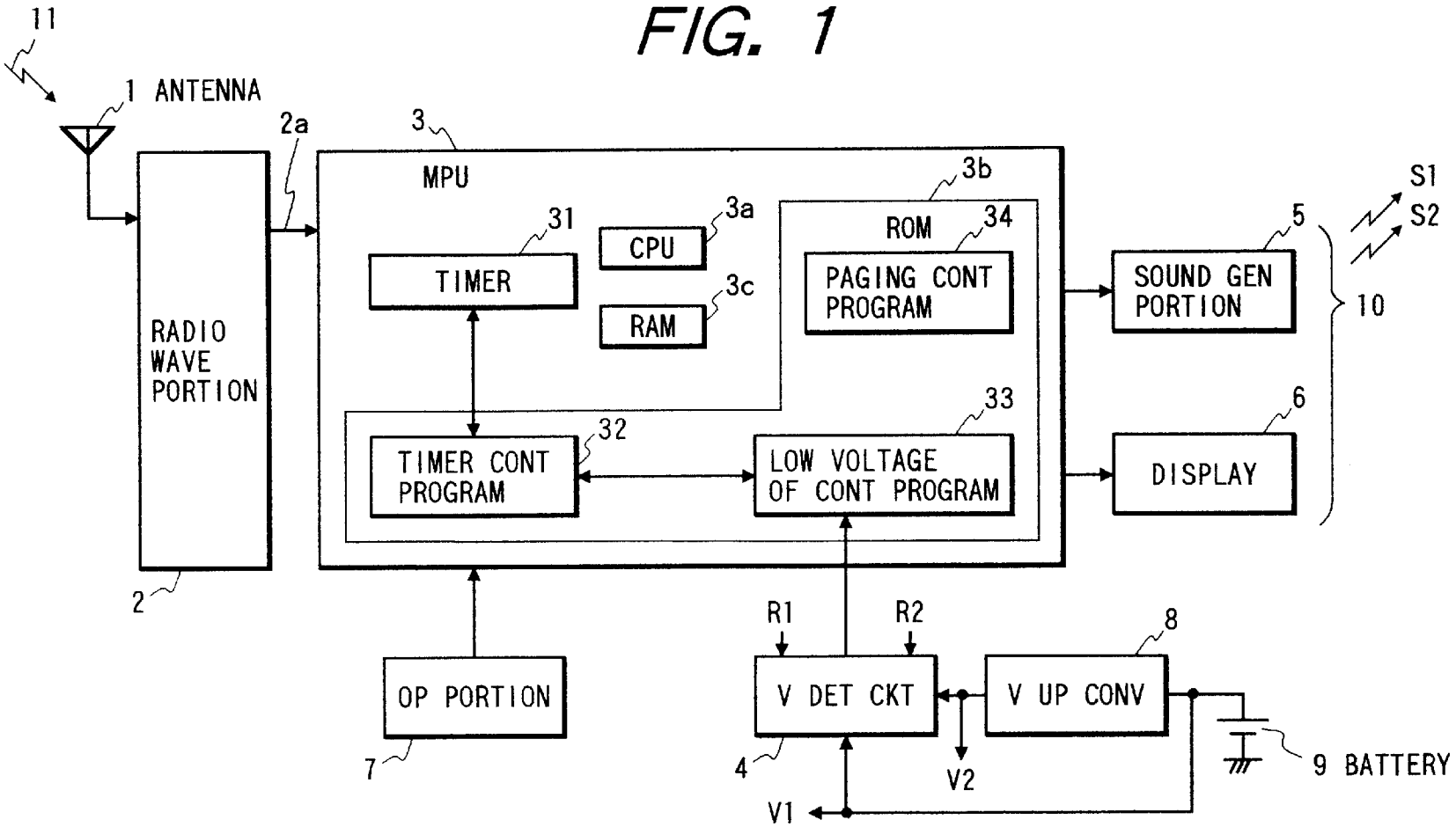
FIG. 1 is a block diagram of a pager with a low voltage alarm of this embodiment.

Hereinbelow will be described an embodiment of this invention.

FIG. 1 is a block diagram of a pager with a low voltage alarm of this embodiment.

The pager of this embodiment comprises an antenna 1 for receiving a radio wave paging signal 11, a radio wave portion 2 for amplifying, demodulating, and decoding the radio wave paging signal and for outputting a paging signal 2*a*, a microprocessor (mpu) 3 for receiving the paging signal and effecting a paging operation and a low voltage alarming operation, a display 6 for displaying character information or mark information under control of the microprocessor 3, a sound generation portion 5 for generating a sound under control of the microprocessor 3, an operation portion 7 for receiving an operation by a user and supplying a command signal to the microprocessor 3, a battery 9 for supplying a supply power V1 which is equal to an emf (electromotive force) of the battery 9 to respective circuits of this pager to be directly supplied with the supply power V1, a voltage-up converter 8 for generating and supplying a voltage-up supply power V2 to respective circuits of this pager requiring a relative high voltage and a voltage detection circuit 4 for detecting a low voltage in the supply power V1 and the voltage-up supply power V2.

The microprocessor 3 comprises a cpu (central processing unit) 3*a*, a ROM 3*b*, a RAM 3*c*, and a timer 31. The ROM 3*b* stores identification data of this pager, a timer control program 32 for controlling the timer 31, a low voltage operation control program 33 for storing the condition of a low voltage detection from the voltage detection circuit 4 in the RAM 3*c* and for controlling an alarm operation, and a timer control program for controlling the timer 31.

An alarm portion 10 includes the sound generator 5 and the display 6 which provides paging information to the user in the normal condition as well known.

An operation of the pager of this embodiment will be described.

The antenna 1 receives the radio wave paging signal 11. The radio wave portion 2 amplifies the received radio wave paging signal, and demodulates and decodes it and supplies the paging signal 2*a* to the microprocessor 3. The microprocessor 3 receives the paging signal and effects the well-known paging operation and the low voltage alarming operation. The display 6 displays character information or mark information under control of the microprocessor 3 to display the message included in the paging signal directed to this pager and further displays the predetermined message indicative of the low voltage detection. The sound generation portion 5 generates the sound under control of the microprocessor 3 to inform an arrival of a message directing to this pager with a first predetermined tone and further inform the low voltage detection indicative of the low voltage detection with a second predetermined tone. The operation portion 7 receives an operation by a user and supplying a command signal to the microprocessor 3. The battery 9 supplies the supply power V1 to respective circuits of this pager to be directly supplied with the supply power V1. The voltage-up converter generates and supplies the voltage-up supply power V2 to respective circuits of this pager. The voltage-up supply power V2 is higher than the supply power V1. The voltage detection circuit 4 detects a low voltage in the supply power V1 and the voltage-up supply power V2.

The low voltage detection operation will be described more specifically.

When the voltage of the supply power V1 decreases and is lower than a reference R1 and when the voltage of the voltage-up supply power V1 decreases and is lower than a reference R2, the voltage detection circuit 4 informs the microprocessor 3 of a low voltage condition. The microprocessor 3 stores the low voltage condition in the RAM 3C with the low voltage operation control program 33 and starts the timer to which a predetermined time interval has been set with the timer control program 32.

In this condition, if the user operates the operation portion 7, the microprocessor 3 operates the alarm portion 10 to inform the user of the low voltage condition with the low voltage operation control program 33. That is, the microprocessor 3 informs the user of the low voltage condition by an alarm sound by the sound generation portion 5 and by character data or mark data by the display 6. If the user does not operate the operation portion 7 within the predetermined time interval, the timer 31 informs the expiry of the predetermined interval. In response to this, the low voltage operation control program 33 operates the alarm portion 10 to inform the user of the low voltage condition.

The references R1 and R2 are determined such that suitable margins of the supply voltages V1 and V2 to provide the paging operation for a while and keep data such as telephone number data in the pager. The predetermined interval is determined in consideration of the margins and an actual capacity of the battery which may be decrease with the passage of time and an amount of current consumed in the pager in waiting condition to prevent the battery from being completely discharged. That is, the predetermined interval is determined in consideration of at least the capacity of the battery 9 and an electric power consumption of this pager.

When there is an arrival of the radio wave paging signal directing to this pager, the sound generation portion 5 generates the alarm sound having a first tone s1 to inform the arrival of the paging signal. When the low voltage condition is detected as mentioned, the sound generation portion generates the alarm sound having a second tone s2 which is different from the first tone to inform the user of the low voltage condition.

As mentioned, the alarm portion informs the user of the low voltage condition when the user operates the operation portion 7, so that the low voltage condition is surely informed without an useless alarming which consumes the electric power in the battery 9 and the alarm of the low voltage condition is transmitted to the user when the predetermined interval has passed. That is, the user is informed of the low voltage condition when the user is present near the pager but the user does not operates the operation portion for example.

What is claimed is:

1. A pager comprising:

receiving means for receiving a radio wave paging signal and generating a paging signal;

outputting means for receiving said paging signal and at least outputting information indicative of an arrival of said paging signal when said paging signal corresponds to said pager;

power supplying means for supplying a supply power;

detection means for detecting that a voltage of said supply power is lower than a reference;

operation means for generating a command signal in response to an operation by a user;

alarming means for alarming in response to generation of said command signal by said operation means and detection that said voltage of said supply power is lower than said reference by said detection means; and timer means for measuring a predetermined time interval in response to said detection means, wherein said alarming means alarms in response to measurement of said predetermined time interval by said timer means if said operation means does not generate said command signal within said predetermined time interval.

2. A pager as claimed in claim 1, wherein said alarming means comprises sound generation means for generating an alarm sound when said alarming means alarms.

3. A pager as claimed in claim 2, wherein said sound generation means generates said alarm sound having a first tone when said paging signal directed to this pager arrives and said alarm sound having a second tone informing the user of a low voltage when said detection means detects that a voltage of said supply power is lower than a reference.

4. A pager as claimed in claim 2, wherein said sound generation means generates said alarm sound having a first sound tone when said paging signal directed to this pager arrives and said alarm sound having a second sound tone informing the user of a low voltage when said detection means detects that a voltage of said supply power is lower than a reference.

5. A pager as claimed in claim 1, wherein said alarming means comprises character display means for displaying predetermined character data when said alarming means alarms.

6. A pager as claimed in claim 1, wherein said power supplying means comprises a battery for generating a first supply power and a voltage converter for generating a second supply power from said first supply power, said detection means detects that said voltage of said supply power is lower than a reference by comparing a voltage of said first supply power with a first reference and comparing a voltage of said second supply power with a second reference, and said alarming means alarms when said operation means generates said command signal after said detection means detects that said first voltage of said first supply power is lower than said first reference and when said operation means generates said command signal after said detection means detects that said second voltage of said second supply power is lower than said second reference.

7. A pager as claimed in claim 1, wherein said radio wave paging signal includes paging information and said outputting means further outputting said paging information from said receiving means when the paging signal is directed to said pager.

8. A pager as claimed in claim 1, wherein said alarming means comprises sound generation means for generating an alarm sound directly indicating that said voltage of said supply power is lower than said reference when said alarming means alarms.

* * * * *